US008441192B2

(12) United States Patent
Chidiac

(10) Patent No.: US 8,441,192 B2
(45) Date of Patent: May 14, 2013

(54) LED BASED LAMP REPLACMENT

(76) Inventor: Amina M. Chidiac, Saugerties, NY (US)

( * ) Notice: Subject to any disclaimer, the term of this patent is extended or adjusted under 35 U.S.C. 154(b) by 189 days.

(21) Appl. No.: 12/930,202

(22) Filed: Dec. 31, 2010

(65) Prior Publication Data

US 2012/0169227 A1 Jul. 5, 2012

(51) Int. Cl.
*H01J 7/44* (2006.01)

(52) U.S. Cl.
USPC ..... 315/35

(58) Field of Classification Search ..... 315/35, 315/197, 268; 362/186, 362, 363, 311.01, 362/311.02, 311.03, 311.04, 311.05, 311.06, 362/800
See application file for complete search history.

(56) References Cited

U.S. PATENT DOCUMENTS 4,010,400 A * 3/1977 Hollister ..... 315/248
5,167,556 A 12/1992 Stein
6,443,594 B1 9/2002 Marshall et al.
7,111,972 B2 9/2006 Coushaine et al.
7,228,052 B1 6/2007 Lin
7,256,547 B2 * 8/2007 Kubota et al. ..... 315/56
7,287,896 B2 10/2007 Okamoto et al.
7,341,365 B2 3/2008 Basile et al.
7,344,290 B2 3/2008 Huang et al.
7,357,528 B2 * 4/2008 Marsh ..... 362/223
7,556,406 B2 * 7/2009 Petroski et al. ..... 362/294
7,575,359 B2 8/2009 Saito
2005/0270794 A1 12/2005 Okamoto et al.
2006/0012984 A1 1/2006 Coushaine et al.
2007/0064418 A1 3/2007 Huang et al.
2007/0139946 A1 6/2007 Basile et al.
2008/0192458 A1 8/2008 Li
2008/0211429 A1 9/2008 Saito
2008/0259641 A1 10/2008 Suzuki et al.
2009/0027914 A1 1/2009 Wu
2009/0237954 A1 9/2009 Goto et al.
2009/0257220 A1 * 10/2009 Lenk et al. ..... 362/186
2009/0284968 A1 11/2009 Kuo et al.
2010/0002444 A1 1/2010 Konaka
2010/0008101 A1 1/2010 Bucher
2010/0027270 A1 2/2010 Huang et al.
2010/0097821 A1 4/2010 Huang et al.
2010/0188839 A1 7/2010 Li
2010/0188867 A1 7/2010 Li
2010/0207505 A1 8/2010 Tessnow
2010/0208488 A1 8/2010 Luo
2010/0254121 A1 10/2010 Zhou
2010/0270905 A1 10/2010 Hong
2010/0283369 A1 11/2010 Chen

* cited by examiner

*Primary Examiner* — Minh D A
(74) *Attorney, Agent, or Firm* — Lawrence D. Cutter

(57) ABSTRACT

The present invention provides an energy efficient replacement for a standard incandescent lamp using LED devices which direct their light output into a light transmissive medium which is also capable of radiating the transmitted light outwardly in a plurality of directions. More particularly, the present invention provides an incandescent lamp replacement which is virtually identical in external form factor to the standard incandescent lamp.

7 Claims, 5 Drawing Sheets

LED BASED LAMP REPLACMENT

TECHNICAL FIELD

The present invention is generally directed to lighting devices. More particularly, the present invention is directed to energy efficient lamps using LED (Light Emitting Diodes) as a light source. Even more particularly, the present invention is directed to lighting devices incorporating LEDs in a manner closely conforming to the structure of present day incandescent lamps, also more commonly referred to as "light bulbs."

BACKGROUND OF THE INVENTION

Recent developments in the design and powering of semiconductor based lighting devices, particularly those known as LEDs and OLEDs (Organic Light Emitting Diodes), have provided a significant increase in light production efficiency, measured say, in lumens per watt. Compact power conversion units have also been developed which are efficient in their conversion of household AC voltage levels to a lower DC level suitable for powering LED and other similar semiconductor devices. Additionally, there exist semiconductor light emitting devices that are usable using AC voltage sources.

However, the lighting devices currently available using the advanced technologies referred to above generally do not provide the same shape or form factor associated with the standard incandescent light bulb (lamp). Philips Manufacturing Co. does make an LED based lamp that attempts to duplicate the form factor of a standard light bulb but they do not employ light guide like structures.

It is also noted that various governmental institutions at numerous levels have opted to replace the standard incandescent lamp with more energy efficient devices. The incandescent lamp has, however, completely permeated the design and structure of myriads of associated structures ranging from desk and floor lamps, lamp fixtures, refrigerators, luminaires, drop lights, etc. Accordingly, it is desirable to provide an efficient light source that duplicates as closely as possible the shape and size of the conventional incandescent lamp in as many situations as possible.

Attempts have been made to address some of the issues presented above, but they have not fully solved all of the concomitant problems. For example, in U.S. Pat. No. 7,344,290 issued on Mar. 19, 2008, the inventors Huang et al. appear to describe an LED based lamp structure resembling a tubular fluorescent lamp device. Like other efforts described below, this patent relies on the use of light guides and reflectors. For the purposes of the present application, and as is well understood in the art, a light guide is an optical device intended for the transmission of light from a source point to a destination point with losses along its length designed to be minimal. The art also considers light guides and light pipes to be essentially the same devices.

In U.S. Pat. No. 7,228,052 issued to Wei-Cheng Lin on Jun. 5, 2007, one or more LEDs are employed in conjunction with a light pipe, but the resulting configuration bears no resemblance to a standard light bulb. In U.S. Pat. No. 7,111,972 issued on Sep. 26, 2006, Coushaine et al. describe a lamp using LEDs and a light pipe which conducts light directly from an LED light source to a deflector. Again, the resulting devices shown therein bear little similarity to the congenital incandescent light bulb.

In published patent application U.S. 2010/0283369 A1 published on Nov. 11, 2010, Chen describes an LED bulb and lamp holder. However, again, it is a structure which uses light guides to direct light from a source directly to a destination.

The structure of the devices described in this publication which are described as light guides rather appear merely to be conically shaped cavities having reflective properties for directing light from one or more LEDs directly to the outside of the device. Again, while there is an attempt therein to duplicate the shape of a standard incandescent bulb, the resulting structure actually has more of a flat ellipsoid shape.

In published patent application US 2010/0208488 A1 published Aug. 19, 2010, Luo appears to describe an LED lamp structure which is similar to that described by Coushaine et al. above in that light is directed through a light guide directly to a deflector structure.

As can be seen from the above, the art has failed to leverage the benefits provided by LED and other semiconductor light emitting devices in a manner that facilitates the construction of lighting devices having the same form factor of the ubiquitous incandescent lamp.

From the above, it is therefore seen that there exists a need in the art to overcome the deficiencies and limitations described herein and above.

SUMMARY OF THE INVENTION

The shortcomings of the prior art are overcome and additional advantages are provided by a lighting device which comprises: a base having at least two electrical contacts and being configured for lamp socket insertion; an AC to DC power unit disposed within the base and connected to the two electrical contacts; at least one LED device connected to the power unit; and a light transmissive medium coupled to receive light from one or more LEDs and to radiate light outward. In the present invention, the light transmissive medium conducts light not only along its "length" but also is structured or augmented to distribute light in directions substantially transverse to the direction at which it is initially introduced into the transmissive medium.

In a first embodiment of the present invention the light transmissive medium is configured in the shape of loop which resembles a filament structure. Such a filament structure may be as simple as a single loop or may resemble an older fashion lamp filament. In a second embodiment of the present invention, the light transmissive medium actually comprises an outer envelope which is similar in shape to the envelopes found in conventional incandescent lamps.

It is therefore an object of the present invention to provide a more energy efficient source of illumination.

It is also an object of the present invention to provide a lamp which is as close as possible to the standard incandescent lamp.

It is a further object of the present invention to take advantage of the improvements made in LED fabrication, cost, lifetime, ease of use and availability.

It is also an object of the present invention to provide a lamp with replaceable parts thus avoiding the need to discard the whole device at the end of its use.

It is an additional object of the present invention to take advantage of the improvements made in production of light transmissive media including improvements made in extracting light from such media.

Lastly, but not limited hereto, it is an object of the present invention to produce a replacement for a conventional incandescent lamp which is both light weight and substantially immune from easy breakage.

Additional features and advantages are realized through the techniques of the present invention. Other embodiments and aspects of the invention are described in detail herein and are considered a part of the claimed invention.

The recitation herein of desirable objects which are met by various embodiments of the present invention is not meant to imply or suggest that any or all of these objects are present as essential features, either individually or collectively, in the most general embodiment of the present invention or in any of its more specific embodiments.

BRIEF DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

DETAILED DESCRIPTION

Figure 1:
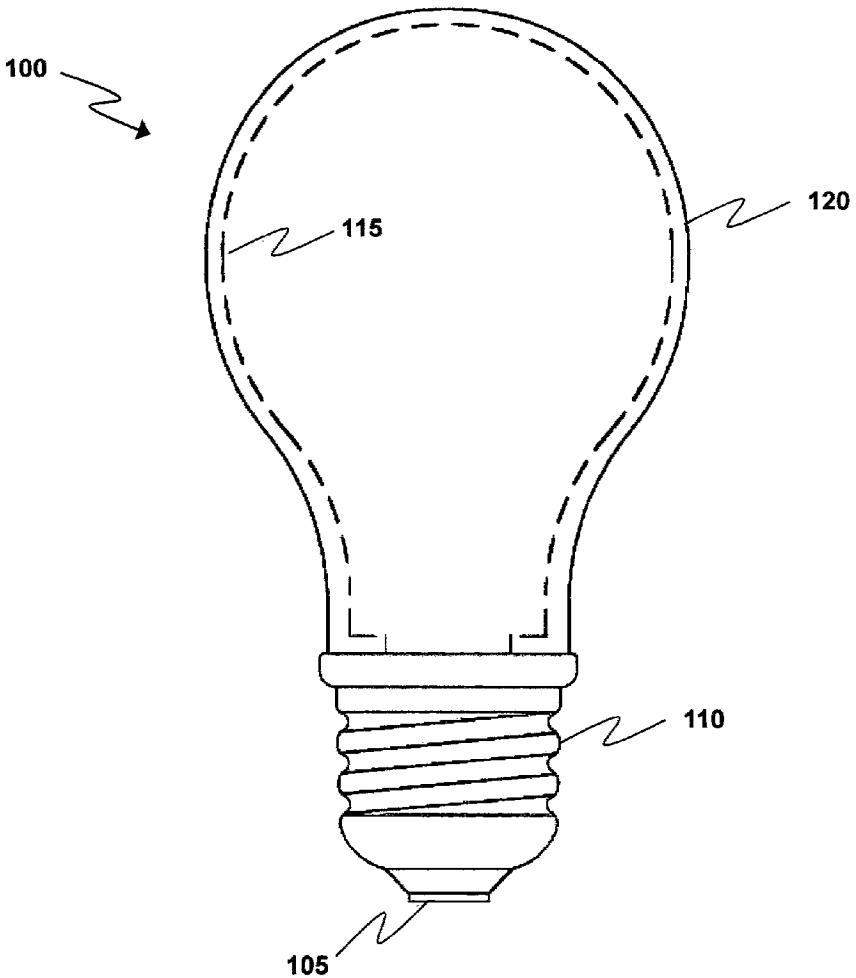
FIG. 1 is a side elevation view illustrating an embodiment of the present invention in which a light transmissive medium is intended to emulate the operational characteristics of a conventional incandescent lamp.

In accordance with one embodiment of the present invention, as seen in FIG. 1, lighting device 100 comprises a socket base for connection to an electrical outlet. In particular, FIG. 1 illustrates the case in which device 100 incorporates a standard screw in, Edison base socket. Other embodiments of the invention incorporate other forms of standard socket fixtures including the well-known bayonet socket. As with all such sockets, there is included two electrical contacts 105 and 110 to provide an electrical connection to a power source. In the embodiment shown in FIG. 1, there is provided a central, bottom contact 105 in addition to a side contact 110. In the embodiment shown, side contact 110 is illustrated as the above-mentioned Edison base socket screw portion.

The lighting device of the present invention also includes outer envelope 120 which comprises a light transmissive medium which is capable of having light inserted at one portion thereof and radiating light outward therefrom along the course of the light through the medium. The medium in question thus acts not only as a light pipe, but also as a light radiating mechanism. Outer envelope 120 preferably comprises a plastic material. This material is also preferably both rugged and light weight. For example, polycarbonate plastic materials which are capable of both transmitting and radiating visible wavelength electromagnetic radiation are desirable for use in the claimed lighting device.

Also illustrated in FIG. 1 is the fact that outer envelope 120 is also desirably coated on the interior thereof with light reflective material 115. This material is preferably deposited on the interior surface of envelope 120. In certain embodiments of the present invention, reflective material 115 constitutes a separate structure having a reflective surface. This, however, is not a preferred embodiment of the present invention since it entails more complicated assembly operations. Since FIG. 1 is only a side elevation view, the LED light sources employed are not visible in this view.

Figure 2:
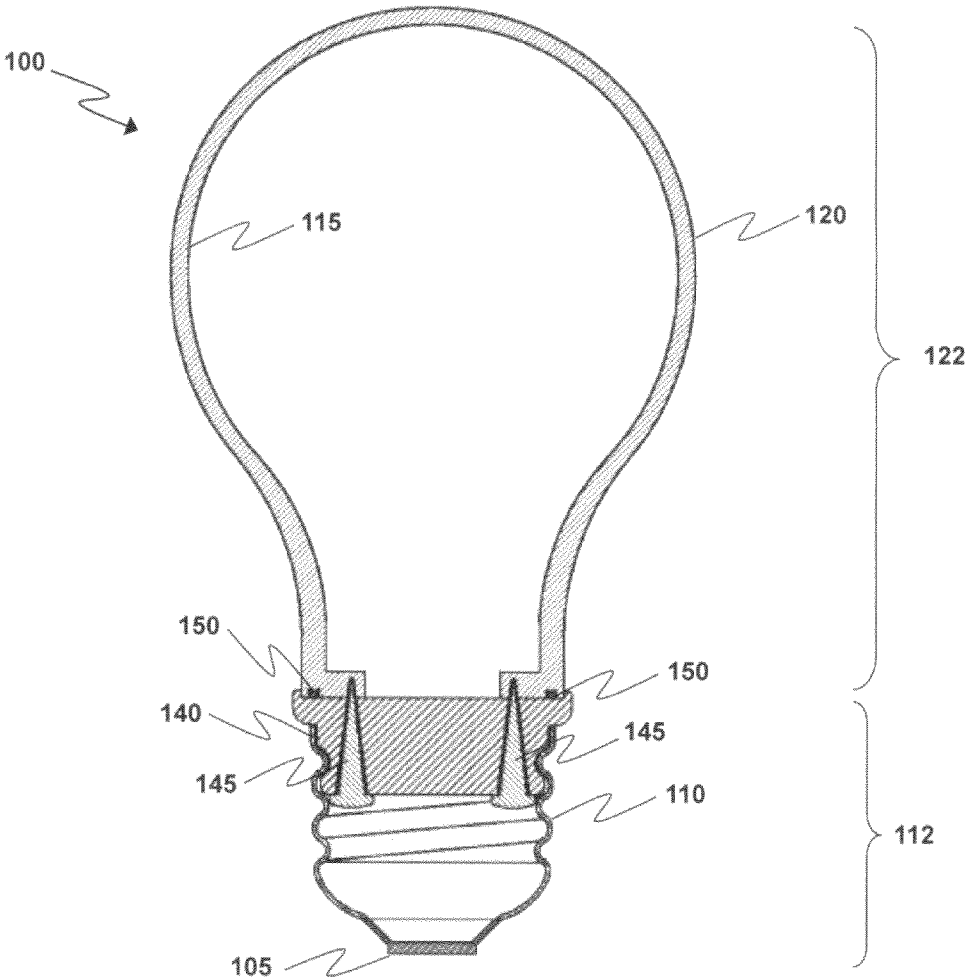
FIG. 2 is a cross-sectional, side elevation view of the lighting device, shown in FIG. 1.

An interior view of the present invention is more particularly illustrated in FIG. 2. In this embodiment heat sink 140 is shown disposed within base structure 112. In particular, it is noted that base structure 112 includes contacts 105 and 110 along with heat sink 140 and fasteners 145. It also includes a power supply such as 190 which is more particularly shown in FIG. 5. FIG. 2 also illustrates that preferred embodiments of the present invention also include an envelope structure 122, which in certain embodiments of the present invention is configured to be detachable from base structure 112. The purpose of providing a detachable base and envelope structure is for both economic and ecological reasons. More particularly, if either one of these structures fails independently of the other, it is replaceable without having to replace the entire unit. However, if it is desired for more ruggedized circumstances, envelope structure 122 is affixable to base structure 112 using an adhesive, such as an epoxy or other ruggedized fastening devices or structures.

Heat sink 140 is desirable in the lighting devices of the present invention in which relatively high levels of light output (and correspondingly higher levels of power input) are provided. Convenient materials for heat sink 140 include aluminum and copper. Heat sink 140 also provides a convenient platform on which to mount a printed circuit board (PCB) containing power supply components and/or the LED devices themselves. Heat sink 140 also provides a convenient attachment point or points for envelope 120. In the embodiment shown in FIG. 2, heat sink 140 is conveniently screwed into contact 110, as illustrated. Envelope 120 is affixable to base unit 112 via any other convenient mechanism as well. It may be affixed to base unit 112 using adhesives, a snap-together connection or, fastening means such as screws, nuts and bolts, or rivets as illustrated by reference numeral 145 in FIG. 2.

Most importantly for the purposes of the present invention FIG. 2 illustrates the presence of LED lighting devices 150 disposed so as to be able to introduce light generated by them into the light transmissive medium of envelope 120. The light introduced therein passes through the material of envelope 120 and also radiates outwardly therefrom along its course. In order to facilitate dispersion of the light outward from envelope 120, it may be fabricated with flakes or particles of light reflective material such as aluminum. It is desirable that, for certain applications, the light dispersive material be distributed in a manner in which higher concentrations are found at further distances from the LED light source(s). However, in general, higher concentrations of light dispersive material are disposed at those locations where greater amounts of light are desired to be radiated outwardly, as opposed to being transmitted within the envelope material as per the phenomenon of total internal reflection.

Figure 5:
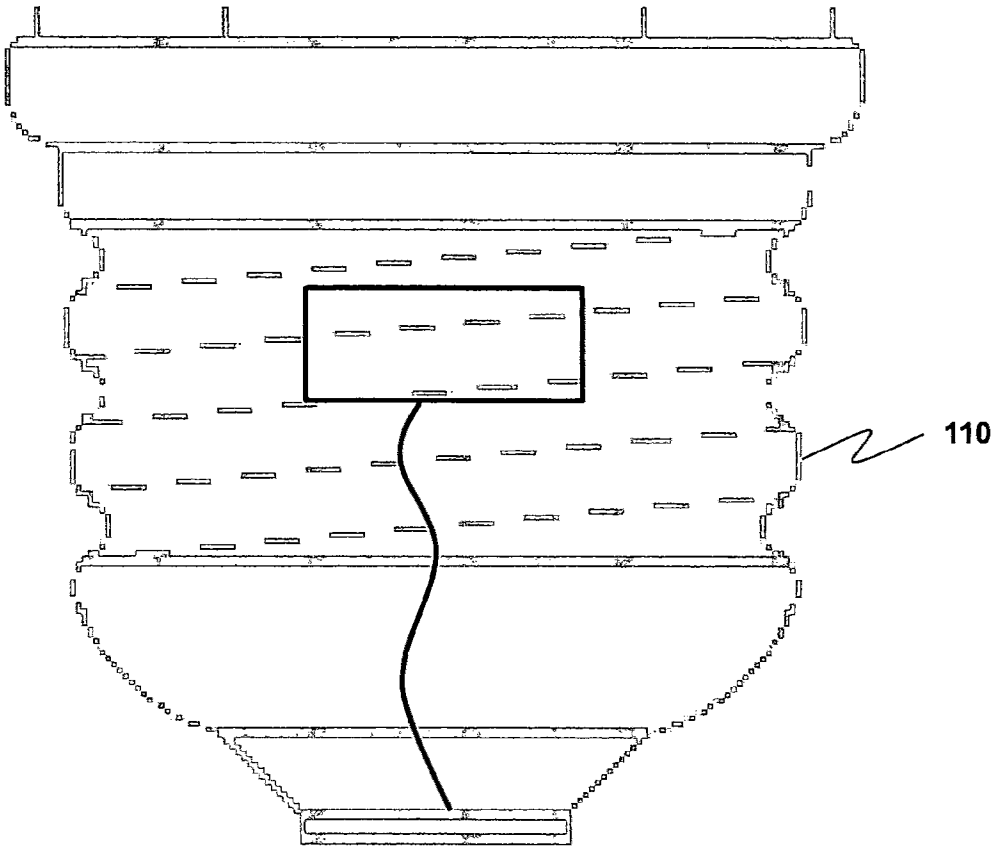
FIG. 5 is a side elevation view of the lighting device of the present invention more particularly indicating the location and connections of a power supply for one or more LEDs.

While FIG. 2 illustrates the presence of two LED light sources 150, any convenient number of LEDs may be deployed. In particular, it is only necessary to include at least one LED. In the embodiment shown in FIG. 2, there is actually provided (though not visible) a plurality of LED devices arranged in a ring structure disposed at the base of envelope 120. In terms of current cost and availability, the LED devices employed in the present invention preferably comprise those driven by direct current power sources. This is more particularly illustrated in FIG. 5. However, LED devices driven by alternating currents are also available. These may be used as well in various embodiments of the present invention. In such cases power supply 190 shown in FIG. 5 is typically replaced by power supply circuitry which adjusts incoming voltage levels to a supply voltage level compatible with the specific LED device being used.

Figure 3:
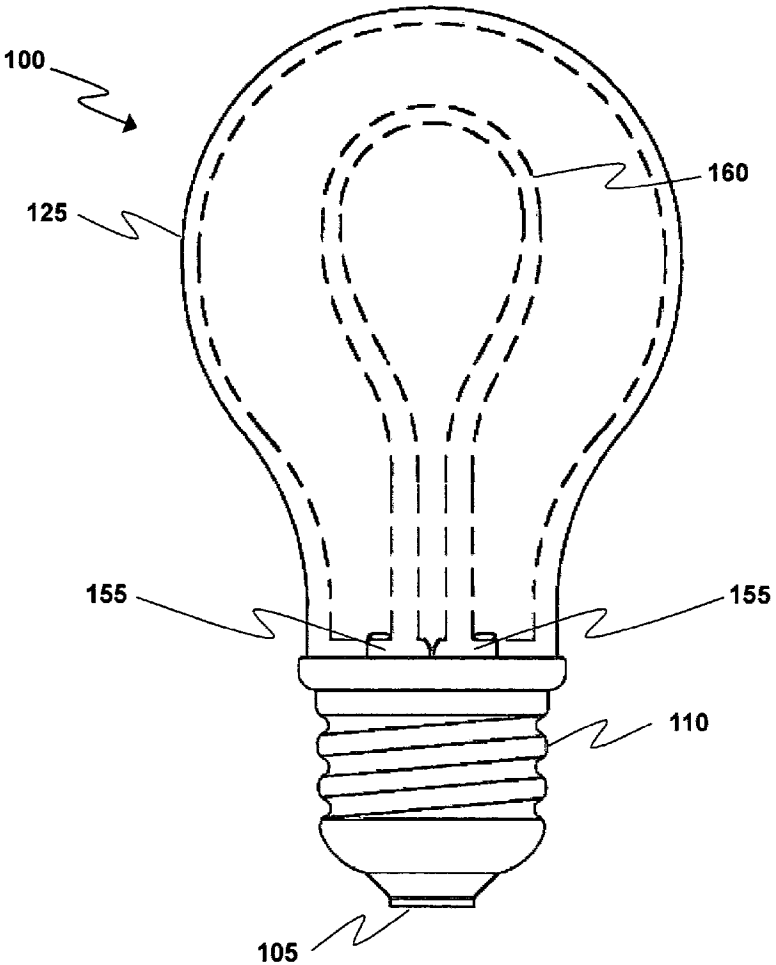
FIG. 3 is a side elevation view of an alternate embodiment of the present invention in which a tubular, light transmissive material emulates the structure evinced in certain older, classic filament designs.

FIG. 3 illustrates, in a side elevation view, a second embodiment of the present invention in which a light transmissive medium is employed in the shape of a loop disposed within an outer translucent envelope. In the illustration shown, loop 160 comprises a light transmissive medium which is also capable of radiating transmitted light in an outward direction. The light is provided by one or more LEDs 155. In this embodiment, in contrast to the embodiment illustrated in FIGS. 1 and 2, outer envelope 125 is translucent and typically comprises materials such as plastic and glass. However, it is preferably shaped to resemble the outer envelope of a conventional incandescent lamp. In this embodiment, loop 160 is intended to resemble a conventional incandescent lamp filament or at least to suggest the presence of one. Tubular structure 160 is, however, not necessarily configured in the specific shape of the loop shown in FIG. 3. It is to be particularly noted that the loop design illustrated in FIG. 3 is only one of a large plurality of shapes that may be employed. These shapes are generally desired to be suggestive of more classic filament shapes and structures but they need not be. In particular, it is even possible to provide a shape to structure 160 which resembles the shape and configuration of the more recently available compact fluorescent lamps. In short, this aspect of the present invention permits a wide range of designs for tubular structure 160. Like envelope 120 in FIGS. 1 and 2, tubular structure 160 is intended to both conduct and radiate visible wavelength radiation. Also, like envelope 120, tubular structure 160 comprises a material which functions both as a light conduit and as a radiator of visible wavelength radiation. Again, like envelope 120, tubular structure 160 comprises essentially the same materials and may be provided with internal light dispersing flakes, particles or fragments for the purpose of improving light emission from various points along tubular structure 160. It is, however, noted that even if structure 160 were to be provided with a square or rectangular cross-section or with any other similar cross-section, it would still live within the scope and contemplation of the claims presented herein. In short, "tubular" is not intended to require a circular cross-section. Any convenient cross-section is deployable within the confines of the present invention.

It is also to be noted that the structures provided in the present invention which are intended to function both as light conduits and as light radiators are not required to have constant thicknesses (as might be the case for the embodiment shown in FIG. 1) or to have constant cross sections (as might be the case for those embodiments illustrated in FIG. 3 herein). The present invention also contemplates the use of diffusing films which may be disposed within the actual material of envelope 120, as opposed to the utilization of after-applied diffusing films, coatings or light scattering layers which may be disposed using a printing, etching process or other such process. The use of such diffusing films is generally employed at those locations where it is desired to have light, which is otherwise conducted within the transmissive medium, radiated outwardly therefrom.

Figure 4:
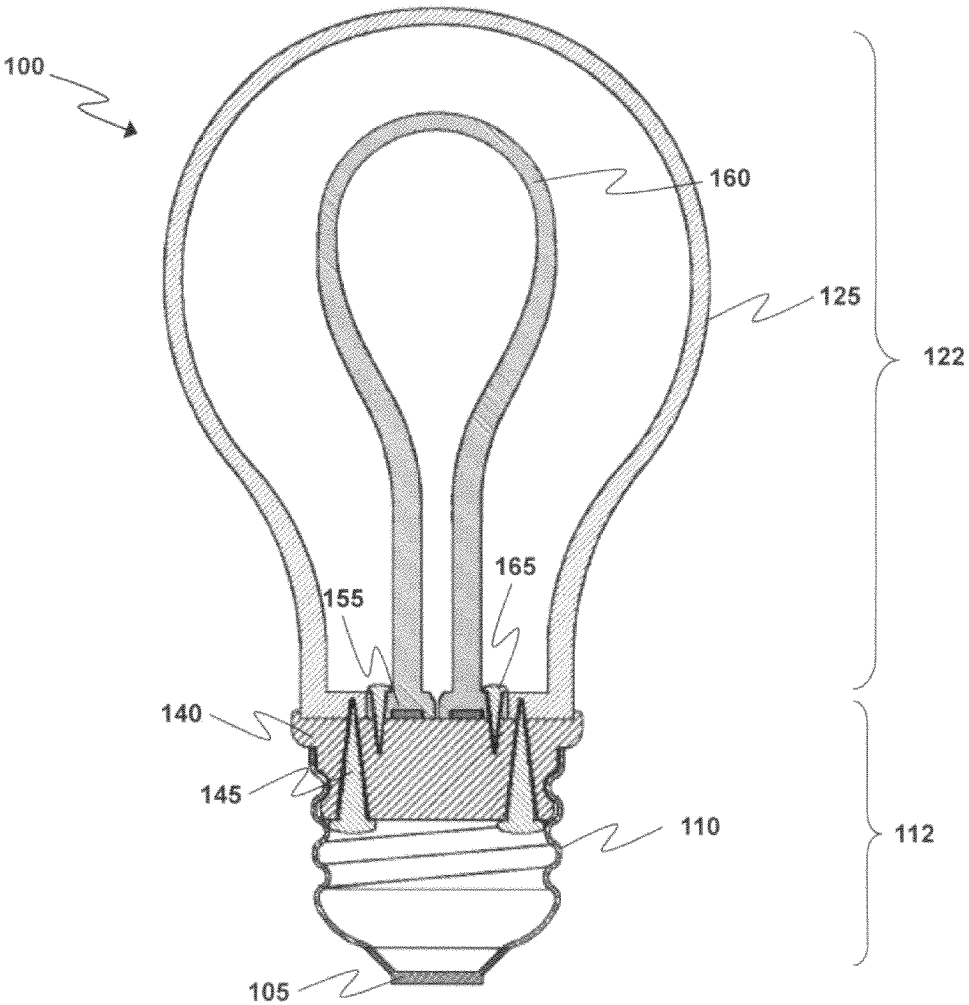
FIG. 4 is a cross-sectional, side elevation view of the lighting device, shown in FIG. 3.

Attention is now directed to the interior structure of the embodiment shown in FIG. 3. As can be seen in FIG. 4, fasteners 145 are employed to affix heat sink 140 to outer envelope 125. Likewise, additional fasteners 165 are employed to affix loop 160 (or its structural equivalent) to heat sink 140 as well. Again, in one of the embodiments of the present invention heat sink 140 screws into side contact 110 which in turn is intended to be screwed into a standard Edison base socket. The embodiment illustrated in FIG. 4 is not intended to act as a snap-together or modularly constructed lighting device. However, a snap in connection is readily provided if desired. In those embodiments in which a snap together connection is provided between envelope structure 122 and base structure 112, it is seen that "filament simulating loop" 160 is easily replaceable thus providing the economic and ecological advantages discussed above. As above, LEDs 155 are employed in FIG. 4 to direct light into structure 160. For reasons of space and the avoidance of overcrowding in the diagram, only one of the two indicated LED devices are referenced.

Attention is next directed to the aspects of the present invention illustrated in FIG. 5. In particular, this illustration provides in both block diagram and side elevation form an indication of one of the possible placements and connections for a power supply. In particular, FIG. 5 illustrates the utilization of an AC to DC converter 190 which is employed to receive power from a standard electrical socket (any one of which is covered by the intended scope of the present invention) and to provide that electrical energy to LED devices which in turn direct their light output into a transmissive medium which is also capable of directing light outwardly therefrom. Converter 190 is provided with connection 175 to side contact 110; converter 190 is also provided with connection 170 to centrally disposed contact 105. Likewise, positive and negative connections 180 and 185 are provided in order to supply power to LED devices 150 and/or 155. AC to DC converter 190 is preferably affixed to heat sink 140 for the purposes of heat removal and dissipation. As indicated above, in those circumstances where the LED devices are powered by alternating current levels, AC to DC converter 190 is replaced by an electrical circuit which provides a voltage suitable for LED operation.

While the invention has been described in detail herein in accordance with certain preferred embodiments thereof, many modifications and changes therein may be effected by those skilled in the art. Accordingly, it is intended by the appended claims to cover all such modifications and changes as fall within the spirit and scope of the invention.

What is claimed is:

1. A lighting device comprising:

a base having at least two electrical contacts and being configured for lamp socket insertion;

a power unit disposed within said base and connected to said two electrical contacts;

at least one LED device electrically connected to said power unit; and a light transmissive medium, having an edge, coupled to receive light from said at least one LED which is disposed so as to direct light emitted from said LED into said edge of said light transmissive medium and to radiate light outwardly from said light transmissive medium, said light transmissive medium having a structure selected from a group consisting of an outer envelope having the shape of a standard light bulb, an envelope having the shape of a tubular fluorescent lamp and a structure resembling filamentary elements in standard incandescent lamps.

2. The device of claim 1 in which said light is radiated in a direction which is substantially transverse to light flow within said light transmissive medium.

3. The device of claim 1 in which said light transmissive envelope is configured to snap onto said base.

4. The device of claim 1 in which said light transmissive medium has a hollow interior.

5. The device of claim 1 in which said light transmissive medium includes a light reflective surface disposed on the interior thereof.

6. The device of claim 1 in which said selected light transmissive medium structure is the outer envelope having the shape of a standard light bulb and in which there are a plurality of LEDs disposed around a mounting surface on said base.

7. The device of claim 1 in which said selected light transmissive medium structure is that resembling filamentary elements in standard incandescent lamps and in which there are two of said at least one LED devices, with each one being coupled to an opposite end of said light transmissive structure.

* * * * *